US007064663B2

(12) United States Patent
Pucci et al.

(10) Patent No.: US 7,064,663 B2
(45) Date of Patent: Jun. 20, 2006

(54) RADIO FREQUENCY OBJECT LOCATOR SYSTEM

(75) Inventors: Donald Pucci, Boca Raton, FL (US); Bianca Gallo Pucci, Boca Raton, FL (US); Isay Goltman, Davie, FL (US)

(73) Assignee: Basix Holdings, LLC, Boca Raton, FL (US)

( * ) Notice: Subject to any disclaimer, the term of this patent is extended or adjusted under 35 U.S.C. 154(b) by 73 days.

(21) Appl. No.: 10/426,575

(22) Filed: Apr. 30, 2003

(65) Prior Publication Data

US 2004/0217859 A1 Nov. 4, 2004

(51) Int. Cl.
*G08B 1/08* (2006.01)

(52) U.S. Cl. ..... 340/539.32; 340/572.1; 340/825.49

(58) Field of Classification Search ..... 340/539.32, 340/539.13, 568.1, 572.1, 328, 691.3, 505, 340/825.49
See application file for complete search history.

(56) References Cited

U.S. PATENT DOCUMENTS

| | | | | |
|---|---|---|---|---|
| 4,101,873 | A | 7/1978 | Anderson et al. | |
| 4,476,469 | A | 10/1984 | Lander | |
| 4,961,575 | A * | 10/1990 | Perry | 340/573.1 |
| 5,214,410 | A * | 5/1993 | Verster | 340/505 |
| 5,410,326 | A | 4/1995 | Goldstein | |
| 5,677,673 | A | 10/1997 | Kipnis | |
| 5,680,105 | A | 10/1997 | Hedrick | |
| 5,689,238 | A | 11/1997 | Cannon, Jr. et al. | |
| 5,748,087 | A | 5/1998 | Ingargiola et al. | |
| 5,776,278 | A | 7/1998 | Tuttle et al. | |
| 5,798,693 | A | 8/1998 | Engellenner | |
| D408,032 | S | 4/1999 | Nagano et al. | |
| 5,936,527 | A * | 8/1999 | Isaacman et al. | 340/572.1 |
| 5,939,981 | A | 8/1999 | Renney | |
| 6,133,832 | A | 10/2000 | Winder et al. | |
| 6,297,737 | B1 | 10/2001 | Irvin | |
| 6,366,202 | B1 | 4/2002 | Rosenthal | |

(Continued)

FOREIGN PATENT DOCUMENTS

EP 0 794 507 A2 9/1997

(Continued)

OTHER PUBLICATIONS

Website hard copy; "The Sharper Image"; Feb. 11, 2003.

*Primary Examiner*—Thomas Mullen
(74) *Attorney, Agent, or Firm*—Akerman Senterfitt

(57) ABSTRACT

An object location system having tags for tracking objects. A finder and tags each have a memory, and RF send and receive capabilities. The finder stores tag identification codes in its memory, and associates the tag identification codes with descriptive text identifying an object to a user. A user selects a descriptive text identifier to locate an object, and the finder transmits a search RF signal including the tag identification code to locate the tag attached to the desired object. The tags receive the search RF signal and compare the transmitted tag identification code with their own stored identification codes. A tag responds to the finder by transmitting a found RF signal if the transmitted and stored tag identification codes match. The finder signals to the user that the object with the selected descriptive text identifier has been located, and indicates a relative proximity of the finder to the object.

39 Claims, 11 Drawing Sheets

U.S. PATENT DOCUMENTS 6,448,886 B1 9/2002 Garber et al.
6,501,378 B1 12/2002 Knaven
6,512,478 B1 1/2003 Chien
6,535,125 B1 * 3/2003 Trivett ..... 340/539.13
6,624,752 B1 * 9/2003 Klitsgaard et al. ..... 340/572.1
6,788,199 B1 * 9/2004 Crabtree et al. ..... 340/539.32
2002/0126010 A1 9/2002 Trimble et al.
2002/0158773 A1 10/2002 Khan et al.

FOREIGN PATENT DOCUMENTS

JP 63005286 1/1988
WO 02/17265 A2 2/2002

* cited by examiner

RADIO FREQUENCY OBJECT LOCATOR SYSTEM

BACKGROUND OF THE INVENTION

1. Field of the Invention

The present invention relates generally to the field of object locator systems, and more specifically to systems which use a radio frequency to locate objects.

2. Discussion of the Prior Art

Many different radio frequency object locator systems exist for enabling people to locate a small number of misplaced objects, such as keys, television remote controls, telephones, purses, eyeglasses and the like. These known locator systems typically include several color-coded object tags, each of which can be attached to an object, such as a set of keys or a television remote control. Such systems typically include a base having a color-coded button associated with each color-coded tag. The base may have a space next to each of the buttons in which a user can enter text describing the object to which the associated tag is attached. A user can press the button on the base to find an object that has been misplaced, and the base emits a radio frequency signal which is specific to the tag attached to the object. The tag responds to the radio frequency signal by emitting an audible signal, such as a beep, allowing the user to locate the missing object. Such a system is described in U.S. Patent Application Publication No. 2002/0126010 to Trimble et al.

Known locator systems are not very robust and have not functioned well. In particular, the known systems only have the ability to find a small number of objects, typically up to about four. In addition, the range of operation of the known systems is limited to about 30 feet. Some of the known systems use different radio frequencies for each object to be located, or use a separate carrier modulation code for each object. Some of the known systems have a pre-programmed code that the base and tag use for identification. These configurations restrict the number of different tags that can be used. For example, U.S. Pat. No. 6,297,737 to Irvin utilizes a Bluetooth transceiver located in a mobile terminal such as a cellphone, which forms the master to a Bluetooth piconet. The system may include up to seven slave Bluetooth devices in addition to the master device. The slave Bluetooth devices may be tags that can be polled to emit an audible signal when knowledge of their location is desired. The tags may also transmit a "found" signal to the master device. While the master device can display on an LCD display that desired tag has been located, the user must track down the tag by listening for the audible signal emitted by the tag. The master device cannot give any indication of proximity to the object. Bluetooth operates in the 2.4 GHz frequency band, which is a government regulated and crowded frequency band. In addition, the number of tags that can be searched for this type of system is extremely limited because of the inherent limitation on the number of devices that may be used in a Bluetooth piconet.

Other systems have been proposed for the location of a larger number of items, such as document files. U.S. Pat. No. 5,798,693 to Engellener describes a system including a tag associated with each object, and a plurality of interrogation signal generators. The signal generators are placed in each room or area of a user's premises, which may be a store or office, and can be caused by a central controller to poll each object tag located within their immediate vicinity. Each tag can include a unique identification code, and may include a resonance circuit that can emit a responsive signal to the signal generators. In another example, U.S. Pat. No. 5,689, 238 to Cannon, Jr. et al. describes a system in which an electronic object tag is identifiable by a unique response code. The response code may be keyed into a portable interrogator by a user, which emits a radio frequency signal including the response code of the desired tag. The tag modulates its reflection of the interrogator's radio signal to allow the interrogator to indicate its relative proximity to the tag. Location markers may be used to amplify the signals and to provide an indication of the location of the object. Notably, both of these described systems have very short ranges of operation, and hence require intermediate signal amplifiers to operate effectively.

The known systems have other disadvantages and limitations, including significant installation expense and operation difficulties. In particular, a user may not wish to constantly poll for the location of all objects having tags, but may wish to simply locate one particular object that is missing. In addition, different users need flexibility in identifying the objects to be located, because entering the tag identification code to locate an object is not intuitive to a user. It is time consuming for a user to have to look up the tag identification code for the object they wish to locate. In addition, the user may not have ready access to the list or database in which they have stored or listed the tag identification codes, further delaying the recovery of the lost object.

It is desirable to produce an improved object locator system, which allows the user a significant degree of flexibility in its set-up and use.

SUMMARY OF THE INVENTION

According to one embodiment of the invention, an electronic object location system includes a plurality of identification tags, each tag having RF send and receive capabilities. Each tag has an internal tag memory for storing a unique tag identification code associated therewith, and is attachable to an object. The system includes a portable finder having a processor and an internal finder memory, and RF send and receive capabilities. The finder stores a plurality of the unique tag identification codes in the finder memory. The tag identification codes are associated in the finder memory with descriptive text identifying an object to a user, the descriptive text identifiers providing an intuitive object identifier. A user can select a stored descriptive text identifier for location of a desired object from the finder memory, and the finder can then transmit a search RF signal to locate the identification tag associated with the desired object using the stored tag identification code associated with the selected descriptive text. The search RF signal includes the selected tag identification code. An identification tag in the vicinity of the finder receives the search RF signal and compares the transmitted tag identification code with its own tag identification code stored in the internal tag memory. The identification tag responds to the finder by transmitting a found RF signal only if the transmitted tag identification code matches its own tag identification code. The finder signals to the user that the object with the selected descriptive text identifier has been located. The user signal indicates a relative proximity of the finder to the desired object.

In one embodiment, the finder may be programmable so that user-defined text may be associated with each identification tag. The tag identification code may be programmed by the finder from stored tag identification codes prior to use of the tag. The finder can include at least one contact for mating with at least one contact provided on the identification tag for programming the identification code into the tag.

The selection of a descriptive text identifier can be taken from a pre-defined list of descriptive text entries.

The finder may sense proximity to the identification tag by the strength of the found RF signal. The finder may have at least one visual indicator to visually signal proximity to the identification tag. Alternatively, or in addition, the finder may further include a sound generator to audibly signal proximity to the identification tag. The finder may have a display for displaying the descriptive text identifiers for selection of tag to be searched for. A scroller may be included on the finder for scrolling up and down a list of descriptive text identifiers. Alternatively, or in addition, the finder can include a keypad input. In another arrangement, the finder may include a text input device.

The radio frequency of the search and found RF signals can be any suitable frequency. The frequency may be in the range of 10 MHz to 10 GHz. One preferred frequency range is 27–50 MHz. The finder memory may be programmable. The finder may have a data input means for downloading data from a computer. In one arrangement, the finder may have rechargeable batteries. A charging cradle may be included for recharging the batteries. The finder can emit a sound if it is left off the charging cradle for longer than a predetermined time period.

The identification tag may have a sound generator to generate a sound when identified to help in location thereof. The identification tag can include a battery, and the identification tag can emit a signal when its battery is low of charge. In one arrangement, the identification tag may transmit an RF signal to the finder when its battery is low, and the finder can display a visual indication or emit a sound indication of a low tag battery. In another arrangement, the identification tag can emit a sound when its battery is low. In one arrangement, the identification tag may be formed from circuitry attached to an object by a manufacturer. The finder may interrogate the identification tag for its identification code at the time that the descriptive text identifier is associated with the tag.

In another embodiment of the invention, a portable finder is provided for use in an electronic object locator system. The finder may include a processor, an internal finder memory, and may have RF send and receive capabilities. The finder stores a plurality of unique tag identification codes in the finder memory. The tag identification codes are associated in the finder memory with descriptive text identifying an object to a user, with the descriptive text identifiers providing an intuitive object identifier. A user can select a stored descriptive text identifier for location of a desired object from the finder memory, and the finder can then transmit a search RF signal to locate an identification tag associated with the desired object using the stored tag identification code associated with the selected descriptive text. The search RF signal includes the selected tag identification code. After a response from the selected identification tag, the finder signals to the user that the object with the selected descriptive text identifier has been located, the user signal indicating a relative proximity of the finder to the desired object.

The finder may be programmable so that user-defined text may be associated with each identification tag. One or more contacts may be included for mating the finder with the identification tag when programming the identification code into the tag. The selection of a descriptive text identifier may be from pre-defined list of descriptive text entries. The finder may sense proximity to the identification tag by the strength of the found RF signal. The radio frequency of the search and found RF signals may be any suitable frequency. The frequency may be in the range of 10 MHz to 10 GHz. One preferred frequency range is 27–50 MHz.

The finder may include at least one visual indicator to visually signal proximity to the identification tag. Alternatively or in addition, the finder may include a sound generator to audibly signal proximity to the identification tag.

A display may be provided, for displaying the descriptive text identifiers for selection of a tag for which a search is desired. The finder may include a scroller for scrolling up and down a list of descriptive text identifiers. In one arrangement, the finder may include a keypad input. In another arrangement, the finder may include a text input device. The finder memory may be programmable. The finder may include a data input means for downloading data from a computer.

In one arrangement, the finder may have rechargeable batteries. A charging cradle may be included for recharging the finder batteries. The finder may emit a sound if it is left off the charging cradle for longer than a predetermined time period.

BRIEF DESCRIPTION OF THE DRAWINGS

There are shown in the drawings embodiments which are presently preferred, it being understood, however, that the invention is not limited to the precise arrangements shown.

DETAILED DESCRIPTION OF PREFERRED EMBODIMENTS

Figure 1B:
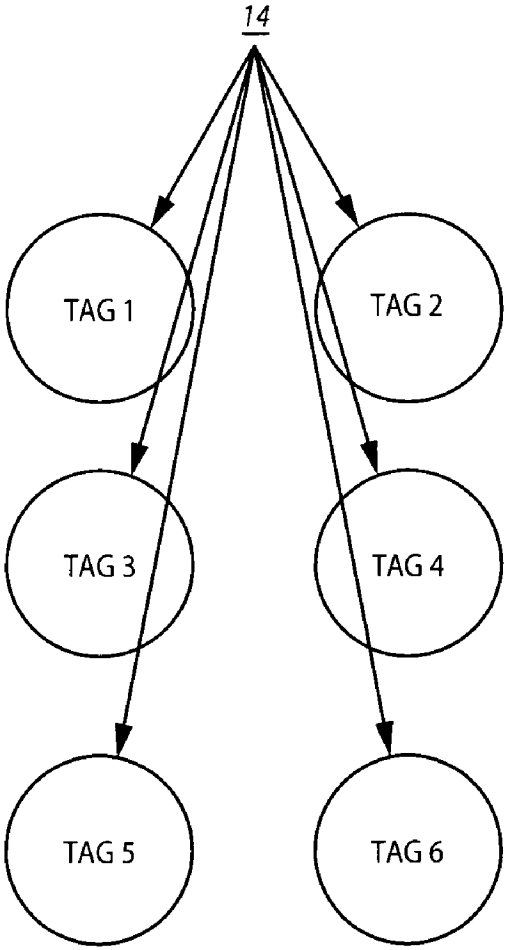
FIG. 1*b* is a schematic view of a plurality of identification tags according to an embodiment of the present invention.
Figure 1A:
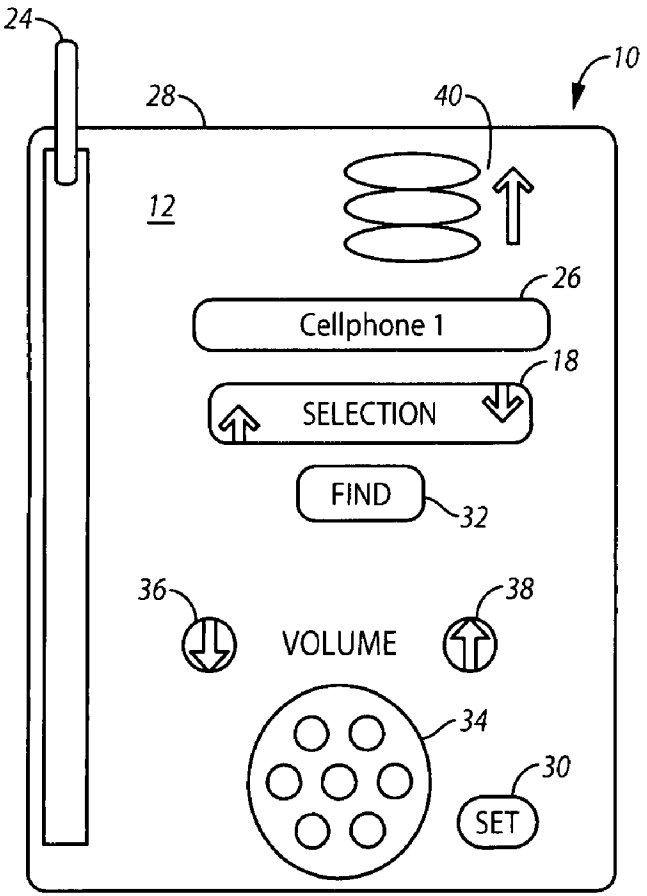
FIG. 1*a* is a schematic view of a finder according to an embodiment of the present invention.
Figure 2:
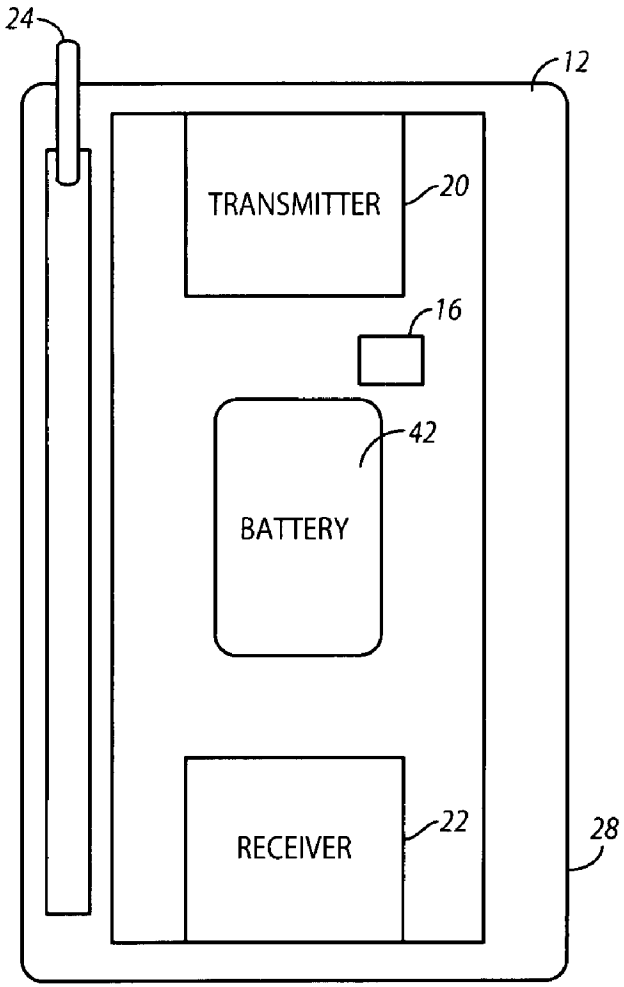
FIG. 2 is a schematic view of a circuit board layout of a finder according to an embodiment of the present invention.

Referring first to FIGS. 1*a*, 1*b* and 2, a radio frequency object locator system 10 includes a portable finder 12 and a plurality of identification tags 14. Each tag 14 may be attached to an object that may need to be located if misplaced.

The finder 12 has a microprocessor 16 with a memory. The memory stores unique identification codes associated with each tag 14, and also a descriptive text identifier associated with that code. The descriptive text identifier is preferably alphanumeric so that both letters and numbers may be used to form an object identifier. The finder 12 may include a selection device 18, such as a scroll bar, scroll wheel, rocker switch or buttons, so that a user may select descriptive text identifying the object that they wish to find.

Figure 3:
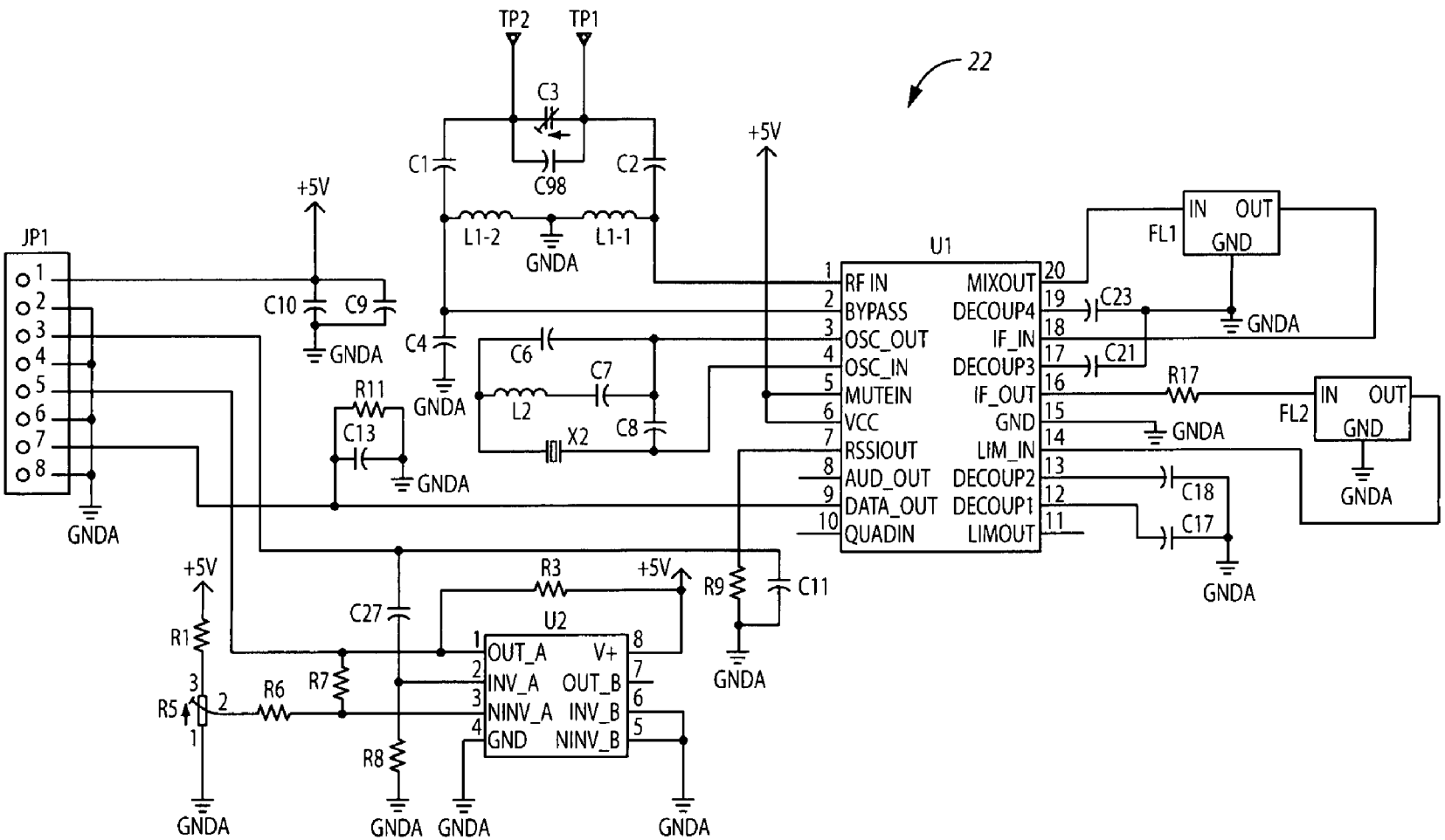
FIG. 3 is a diagram showing a receiver circuit board for use in a finder according to an embodiment of the present invention.
Figure 4:
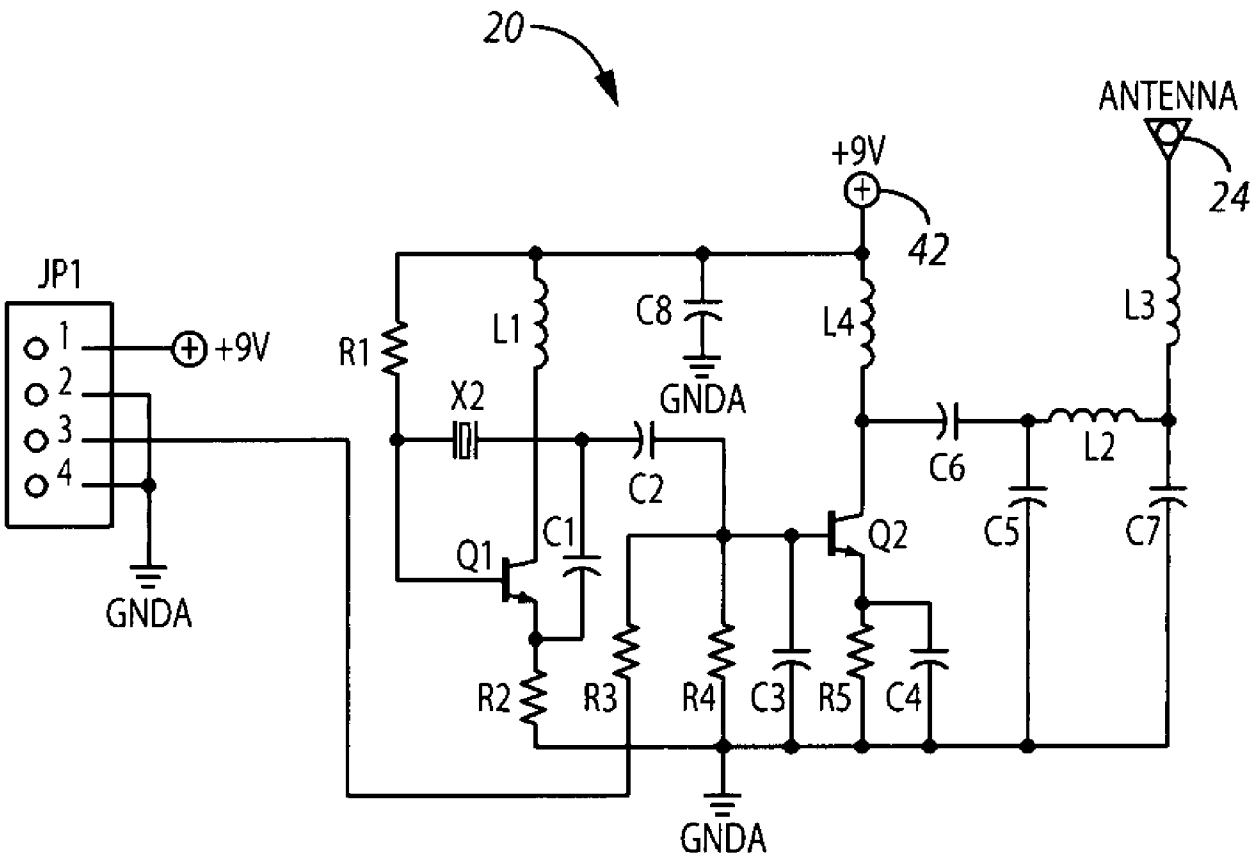
FIG. 4 is a diagram showing a transmitter circuit board for use in a finder according to an embodiment of the present invention.

The finder 12 can also include a radio frequency (RF) transmitter 20, a receiver 22, an antenna 24, and an LCD screen 26 for displaying descriptive text associated with a tag 14. The finder 12 can transmit and receive signals at any suitable frequency. A preferred frequency is in the range of 27–50 MHz. The electronic components of the finder may be provided on one or more printed circuit boards. An example layout for a receiver board is shown in FIG. 3. An example layout for a transmitter board is shown in FIG. 4. In one embodiment, the memory can store up to 4096 tag identification codes and descriptive text identifiers. Preferably, many more than 4096 tags can be identified with the system.

The finder 12 may have a case 28, which may be made of any suitable material, such as a plastic material. The finder 12 may include a case 28 having a set button 30 for programming the identification tags 14, and a find button 32 to begin a finding operation. In one arrangement, the find and set functions may be provided in one button, with the system sensing which operation to execute due to the proximity of a tag at the time that the button is depressed. It will be appreciated that it is not necessary to provide dedicated buttons for the operation of the finder 12. Any suitable means of operating the finder 12 may be employed, such as commands from a keypad, voice recognition means, stylus, touch-screen, and the like.

The finder 12 may include an audible signal generator and/or a visual signal generator to signal proximity of the selected tag to a user. The audible signal generator can generate sounds such as beeps that get louder or higher in frequency as the finder gets closer to the selected tag 14, and may include a speaker 34 with volume up and down buttons 36 and 38. The visual signal generator may include one or more indicator lights 40 that can light up to indicate proximity to the selected tag 14. In the illustrated example, three LED indicator lights 40 are included, the finder 12 indicating proximity to the tag 14 by lighting more of the indicator lights 40 as it approaches the tag 14.

Figure 6:
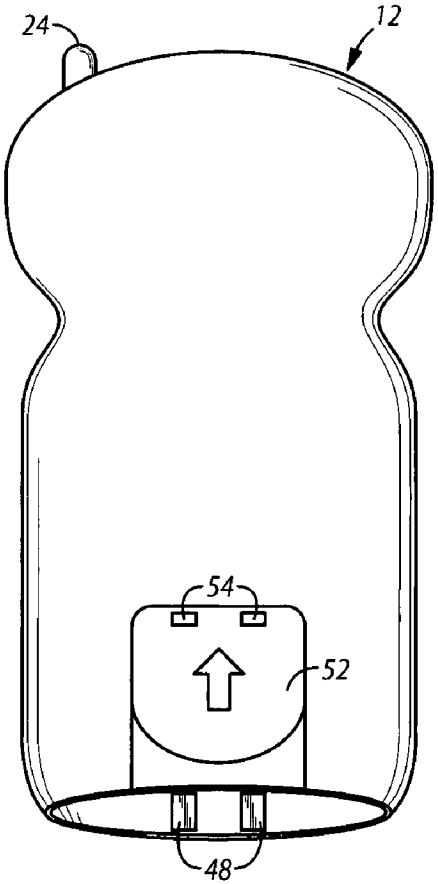
FIG. 6 is a back schematic view of a design for a finder according to an embodiment of the present invention.
Figure 5:
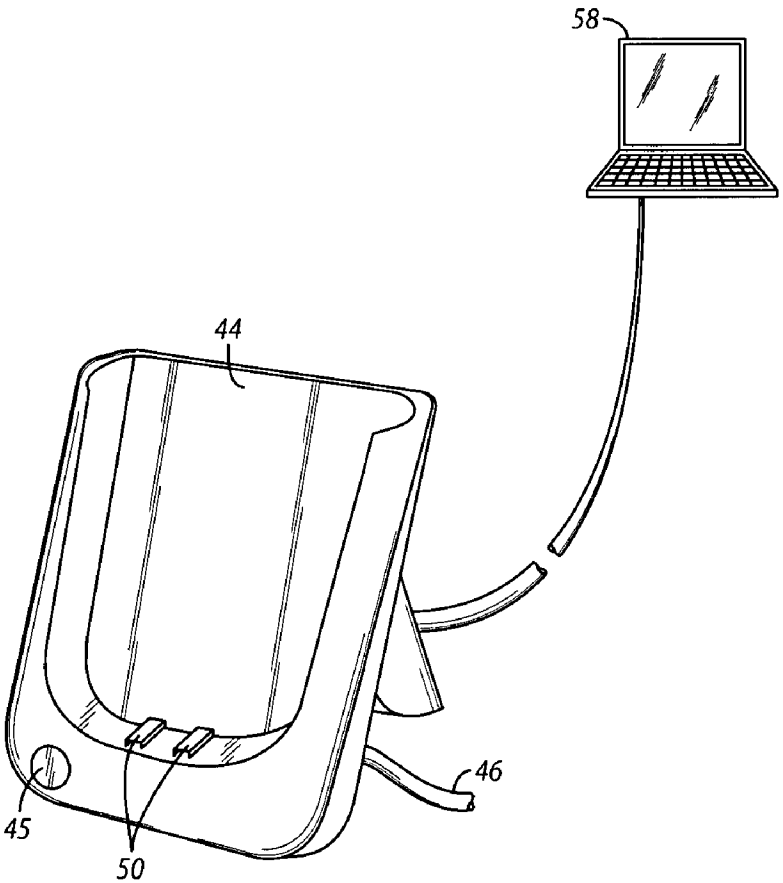
FIG. 5 is a schematic view of a charging station for use with a finder according to an embodiment of the present invention.

The finder 12 may be powered by a battery 42, which may, for example, be a 9V battery, or by any suitable power means. The battery 42 may be rechargeable, and the finder 12 may have a charging station 44 (FIG. 5) that is attachable to a power supply 46 for recharging the battery 42. As shown in FIG. 6, contact pins 48 may be provided on the bottom of the finder for charging purposes, with complementary contact pins 50 in the charging station 44. The finder 12 may emit an audible signal if left off the charging station 44 for too long, using a simple timing mechanism either measuring the time from when the finder 12 is first removed from the charging station 44, or measuring the time from when the finder becomes inactive after use. This reminds a user to quickly replace the finder 12 on the charging station 44, thereby preventing the finder 12 itself from becoming lost. Alternatively, or in addition, the charging station 44 may include a find button 45 that can be pressed by the user to cause the charging station 44 to signal the finder 12 to emit an audible signal. The find button 45 may be usable if the user has misplaced the finder 12.

The finder 12 may include a slot 52 for insertion of a tag 14 for programming, with contact pins 54 located in the slot. It will be appreciated that a slot is not necessary, and that one or more contacts may be provided on the surface of the finder 12 for mating with corresponding contacts on the tag 14. Alternatively, the finder 12 may program the tag 14 using a radio frequency signal without the need for contacts. Programming of the tag via RF signals instead of via contacts may be especially useful where the tags are either embedded into an object during manufacture, or are attached to the object prior to identification with a descriptive text. The finder 12 can either program the tag 14 with a unique identification code, or can interrogate the tag 14 inserted into the tag slot in order to read the tag's unique identification code, if the tag 14 was provided with a code during manufacture. The finder 12 may include a database of tag identification codes in its memory. The programming of the tag may be selectable by the user by means of the set button 30.

The finder 12 may include an alphanumeric key pad 56 (shown in FIG. 9) or other data entry means such as a touch screen, stylus, a touch-screen, voice-recognition means and the like to enable a user to enter user-defined descriptive text entries directly into the finder. Alternatively, the descriptive text entries may be separately programmed and entered into the finder 12, for example, using a separate computer. The descriptive text entries are preferably alphanumeric so that a user can use letters and numbers to identify an object. Numbers are particularly useful when identifying files or other numbered items.

The finder 12 may include means for connection to a computer 58. This may be via a wireless link such as infrared, Bluetooth, radio frequency or any other wireless link, or may be via its charging station 44, a separate cable or any other wire link. A computer link enables the finder memory to be backed up. In addition or in the alternative, the user may enter user-defined text entries into the computer for uploading into the finder. The association with the tag identification code may be entered into the computer at the time that the descriptive text is entered, or may be performed using the finder after the descriptive text has been uploaded.

The finder 12 may be incorporated into another device, such as a BlackBerry (Trademark of RIM) or other personal digital assistant device, which can transmit at 800/900 MHz or 1800/1900 MHz or any suitable frequency, or into a cellphone or other device having RF capabilities. Alternatively, the finder 12 may be a stand-alone device operating at 27–50 MHz or any other suitable frequency. The lower frequency is preferred in some instances because it is less regulated, is becoming more available as most consumer products move to a higher frequency, and has a smaller operating range, meaning that less interference from nearby object locator systems is likely. The finder 12 may operate on only one frequency for all find functions, and may use amplitude modulation to embed the tag identification code into the find signal. Alternatively, other methods of transmitting the find signal may be appropriate.

In one embodiment the finder 12 can track or find up to 4096 objects. Preferably, the finder 12 can track more than 4096 objects. In systems designed to track a large number of objects, such as files, the finder 12 may have suitable memory to track many thousands of objects. In one embodiment, additional finders may be used on a wireless or wired network. The additional finders can act as stationary object locators and signal amplifiers.

Figure 8:
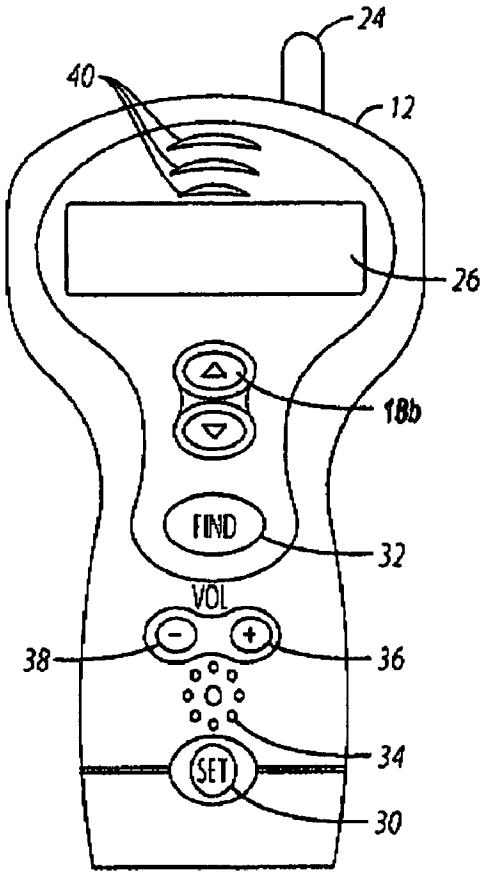
FIG. 8 is a front schematic view of a design for a finder according to another embodiment of the present invention.
Figure 7:
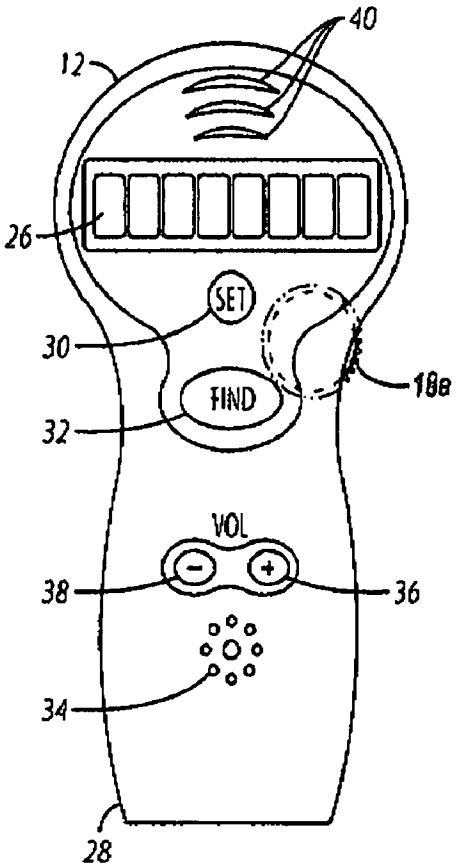
FIG. 7 is a front schematic view of a design for a finder according to an embodiment of the present invention.
Figure 9:
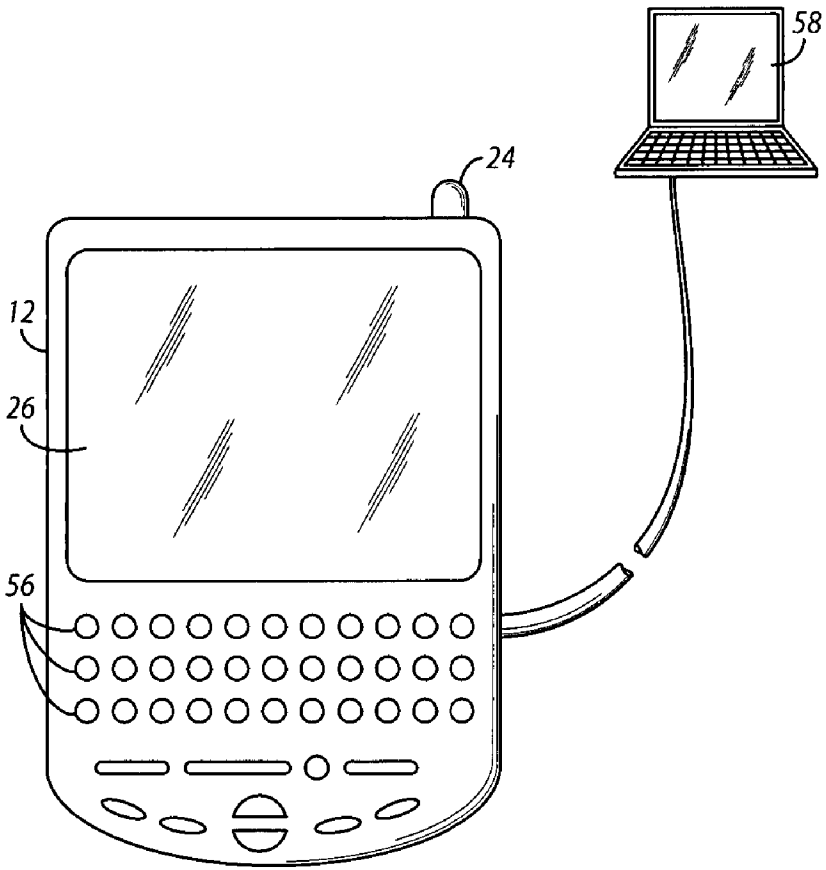
FIG. 9 is a front schematic view of a design for a finder according to yet another embodiment of the present invention.

FIGS. 7–9 illustrate different designs for the finder 12. In one arrangement, shown in FIG. 7, a scroll wheel 18*a* is used for text selection. The text descriptions are displayed on an LCD screen having 8 or more characters. Preferably the LCD screen can display a large number of characters, which may include icons and other pictorial images in addition to the descriptive text identifiers. FIG. 8 illustrates the use of a rocker switch 18*b* for text selection. An extendable antenna 24 is provided, and the set button 30 may be provided low down on the finder 12, close to the tag slot 52. FIG. 9 illustrates an arrangement of finder 12 having a keypad 56, and with a link to a computer 58. It will be appreciated that the design features of the finder are variable, and can be changed according to user/manufacturer preferences and desired functions.

Figure 10:
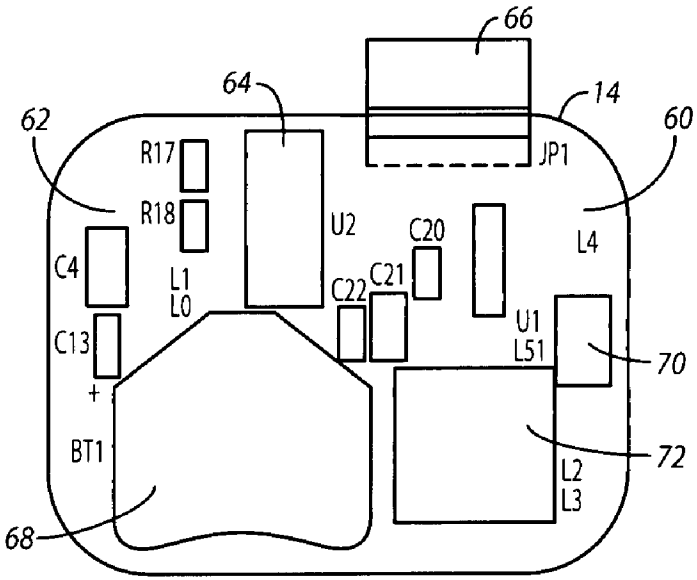
FIG. 10 is a schematic view of a circuit board layout of an identification tag according to an embodiment of the present invention.
Figure 11:
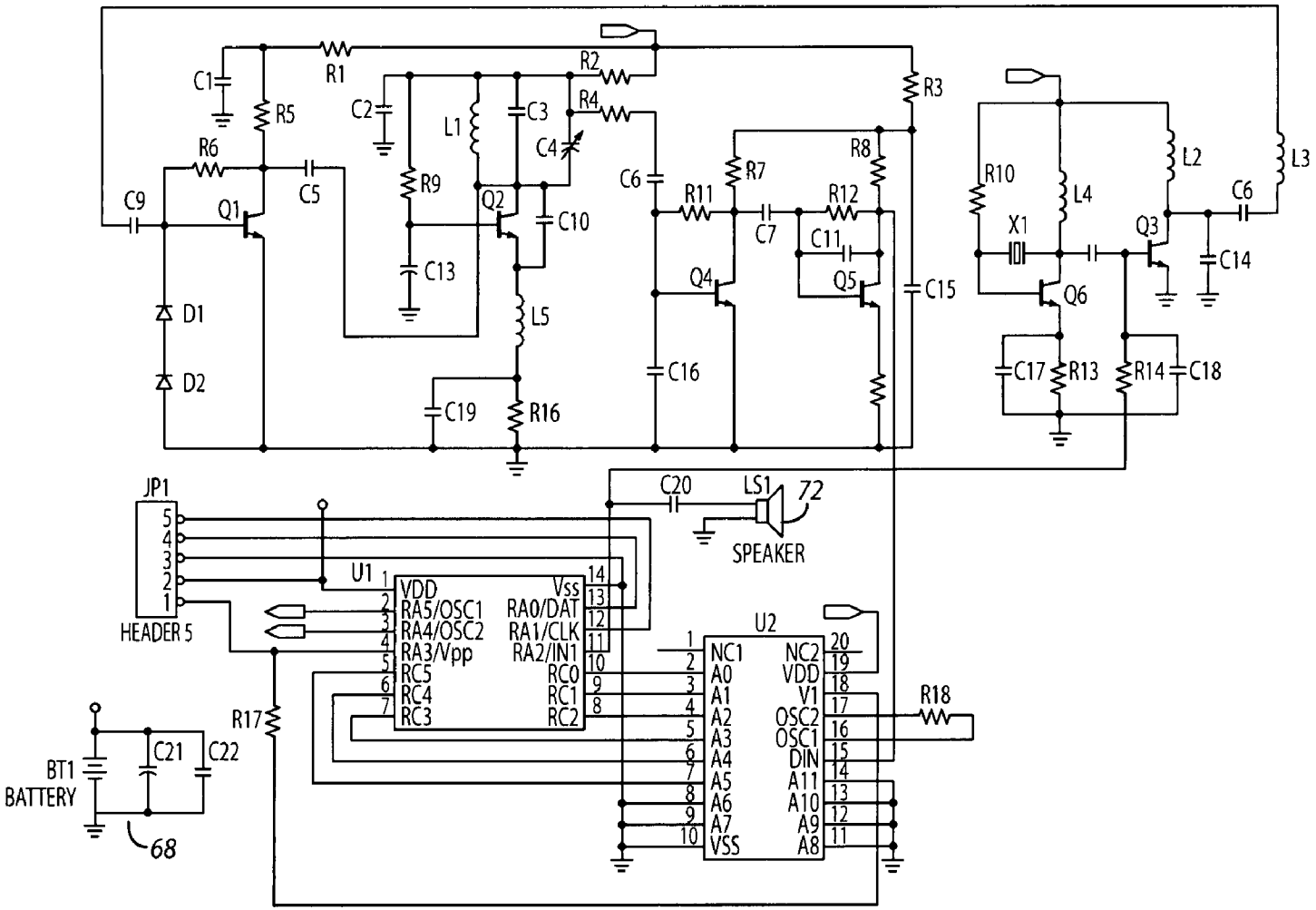
FIG. 11 is a diagram showing a circuit board for use in an identification tag according to an embodiment of the present invention.

Referring now to FIGS. 10 and 11, the tags 14 can also include an RF transmitter 60 and a receiver 62, and each may include a microprocessor 64 having a memory. An antenna 66 may be included. A battery 68 or other power source can also be included. The tags are preferably flat and thin (for example, less than ⅛" thick) so that they can be attached to a large variety of objects. The tags may have a case formed of any suitable material, such as plastic, and may be attachable to any suitable object to be tracked. A hole may be provided in the tag for attachment to a key ring or the like. Alternatively, or in addition, an adhesive layer may be provided on one side of the tag, which may be covered prior to use by a peel-off protective layer. The tag may be flexible so that it can conform to a curved surface. In one embodiment, the tag 14 may include a sound generator 70 with a speaker 72 so that it can beep when it receives its identification code from the finder. The tag may also beep and/or signal the finder when its battery 68 is low. The battery may be rechargeable or the tag may be disposable once the battery has lost power. In another embodiment, the tag may be silent. Two types of tag (such as silent, and beeping tags) may be sold for use with the same finder 12 so that the users may choose the type of tag that they wish to use for each object to be tracked, depending on their budget and preferences. Both types of tag 14 include RF transmitting capabilities to respond to the finder to indicate their location. The electronic components of the tag may be provided on a printed circuit board. An example layout for a tag printed circuit board is shown in FIG. 11.

In a preferred embodiment, the tags 14 as manufactured have no identification code associated therewith. In a preferred embodiment, the identification code may be assigned to the tag 14 by the finder 12 when the user associates a descriptive text identifier therewith. The tag 14 may have one or more contacts (not shown) that can align with one or more contacts 54 on the finder 12 for programming of the tag with its identification code. Alternatively, the identification code may be assigned by the user when entering a descriptive text identifier for the tag on a computer 58. For this purpose, a docking cradle or other communications link (not shown) may be provided between the tag 14 and the computer 58. The identification code and text identifier may then be uploaded into the finder 12. The assignment of tag identification codes into the tags 14 by the user enables a user to buy additional tags to expand their location system at any time and not have any two tags in their location system with the same identification code. In another embodiment, the tag identification code may be stored in the tag 14 by a provider of a location system, or by a manufacturer of an object in which a tag is embedded or otherwise permanently attached.

The tag 14 can transmit an RF response signal indicating that it has been found to the finder 12 continuously or in pulses for a period of time, or until the user signals on the finder 12 that the object has been found. In this way, the finder 12 can analyze the signal received from the tag and can indicate its proximity to the tag 14, either by increasing the volume or frequency of sound generated by the finder 12, or by the plurality of LED indicator lights 40. The finder 12 can determine its proximity to the tag 14 from the strength of the RF found signal received from the tag. The user can then identify the location of the object precisely. The tag 14 may also emit an audible sound such as a beep using sound generator 70 to signal its location, or may remain silent. A silent tag and/or finder may be particularly useful in business or other public settings where it is desirable not to disturb other people located in the same area.

The descriptive text entries may be re-assigned to a new tag 14 once a tag has become inoperable, for example if the tag battery 68 has run down. Alternatively, the user may have purchased a new object as a replacement for an older object, such as a telephone, and may wish to place a new tag on the new object rather than reusing the old tag that was previously assigned to the "telephone" text description.

Figure 12:
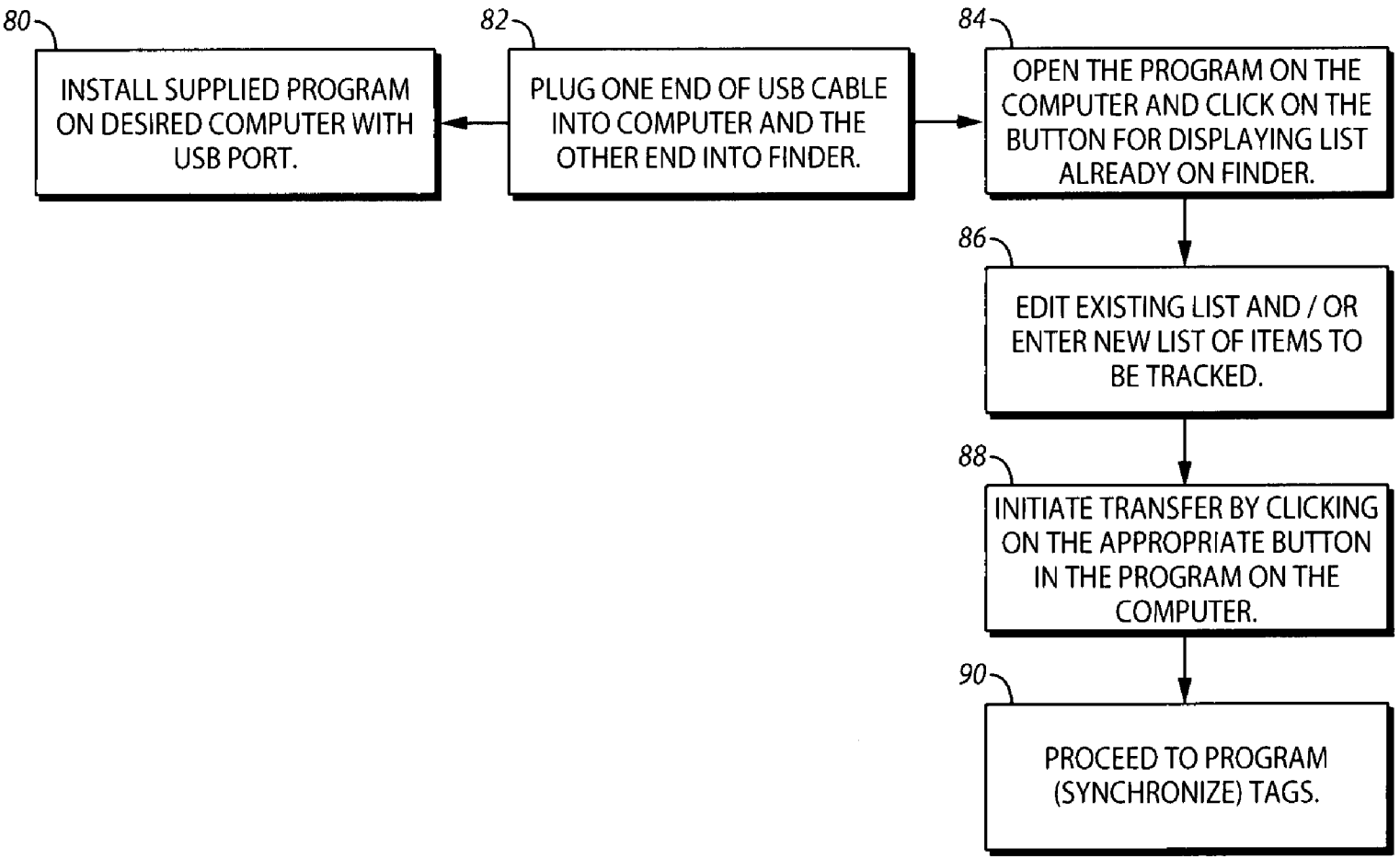
FIG. 12 is a flow diagram for compiling a list of descriptive text identifiers on a computer and programming identification tags according to an embodiment of the present invention.

FIG. 12 is a flow diagram for the maintenance of a list of objects to be tracked on a computer, and for programming of the tag 14. The user at step 80 first installs a program supplied with the object locator system 10 on a desired computer. This may be done via a USB port, via a CD, via the internet, or by any other means. The user then plugs one end of a USB cable into the computer, and the other end of the cable into the finder 12 (step 82). Alternatively, communication between the computer and the finder 12 may be via the charging cradle 44, or by any other means. At step 84, the user opens the program on the computer and displays the list of descriptive text identifiers already loaded into the finder 12. This may be done by clicking a program button displayed on the computer screen, or by any other means. The list of descriptive text identifiers loaded into the finder 12 may have been preloaded at the time of manufacture of the finder 12, or may have been entered into the finder 12 by the user. The user can edit the existing list of text identifiers (step 86), and/or can enter new descriptive text identifiers for objects to be tracked. The descriptive text identifiers can be entered into the computer by the computer keyboard, or in any other manner, such as using a stylus, voice recognition, etc. The user continues to enter descriptive text identifiers as desired. Once the entry of all desired text identifiers is complete, the user initiates a transfer of the descriptive text identifiers to the finder 12 (step 88) by clicking on the appropriate program button on the computer screen. This loads the list of descriptive text identifiers into memory of the finder 12. The user can then use the finder 12 to associate the text identifiers with tag identification codes matching tags to be applied to each object by programming the tags (step 90).

Figure 13:
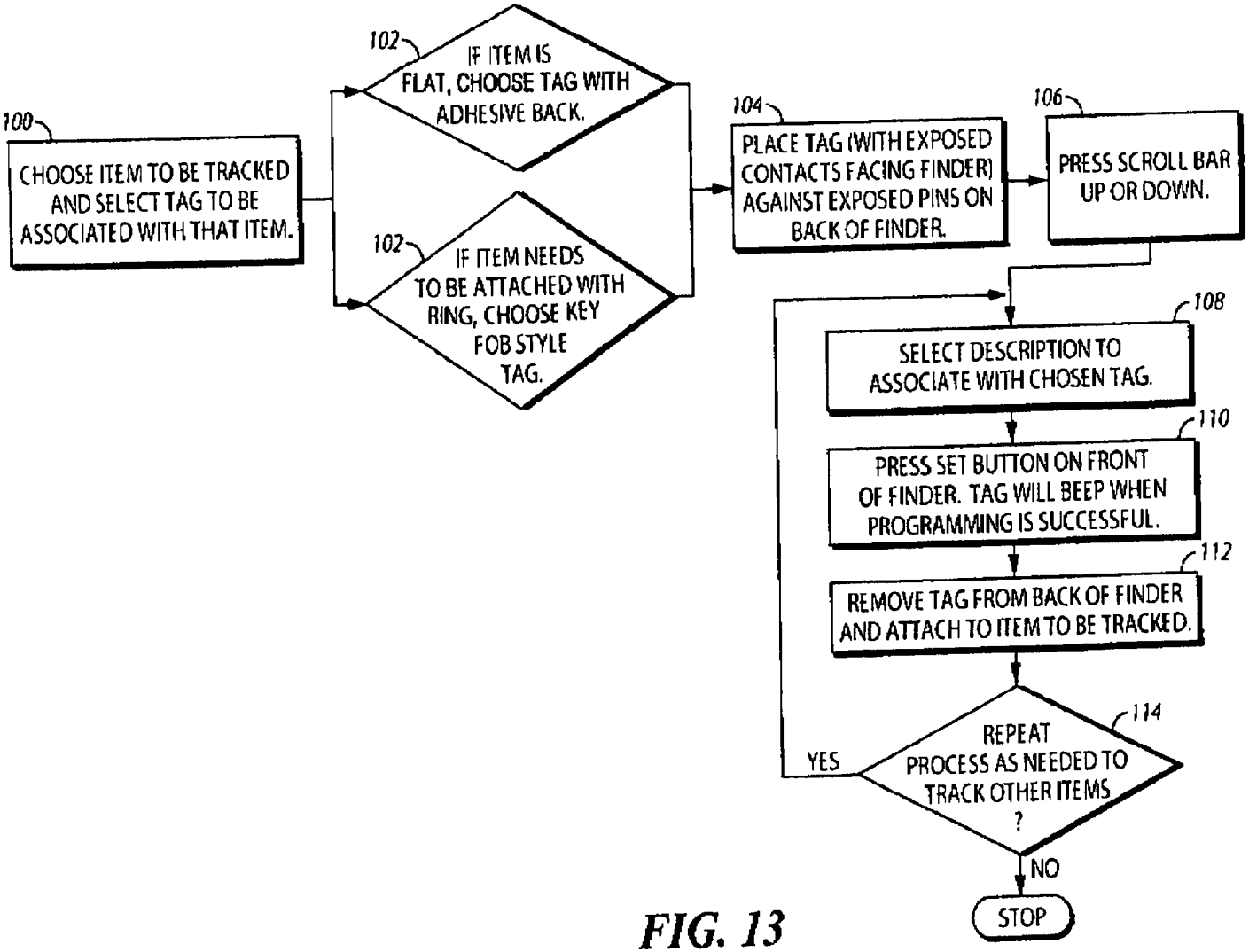
FIG. 13 is a flow diagram for programming an identification tag according to an embodiment of the present invention.

FIG. 13 is a flow diagram for the programming of the tag 14 with its identification code and an associated text description. The user at step 100 first chooses an object to be tracked, which may be any object likely to become misplaced. The user also selects at step 102 an appropriate tag 14 for attachment to the object. The tags 14 may be provided in different designs for selection by the user. For example, some of the tags 14 may be flat, with an adhesive backing.

Some of the tags 14 may have an attachment loop for attaching the tag 14 to a key ring or other attachment point. The tag 14 may be chosen to include an audible signal generator in order that the tag may emit an audible signal when located. Alternatively, the tag may be a silent tag. The user (step 104) places the tag 14 against the finder 12, with the exposed contacts of the tag aligned with exposed contacts 54 of the finder 12. This function may alternatively be performed by inserting the tag 14 into an appropriate slot 52 on the finder 12, or may be achieved by any other suitable method. At step 106, the user can then select or input descriptive text to identify the item that the tag 14 will be attached to. For example, the user can use the scroll bar or buttons 18 to scan through a list of preloaded descriptive text identifiers in the memory of the finder 12. Depending on the embodiment, the user may enter a descriptive text identifier into the finder 12 at this point. The text descriptions are displayed on the LCD screen 26. The user selects an appropriate text description (step 108) and presses the set button 30 (step 110). The finder 12 first selects a unique tag identification code, or reads the pre-programmed identification code from the tag, and then associates the descriptive text with the tag identification code. The tag 14 or the finder 12 may emit an audible signal or otherwise indicate when programming has been successful. The user can then remove the tag 14 from the finder 12, and can attach the tag to the object to be tracked (step 112). The process is repeated as often as necessary (step 114) until the user has programmed all the tags that he/she wishes to use.

Figure 14:
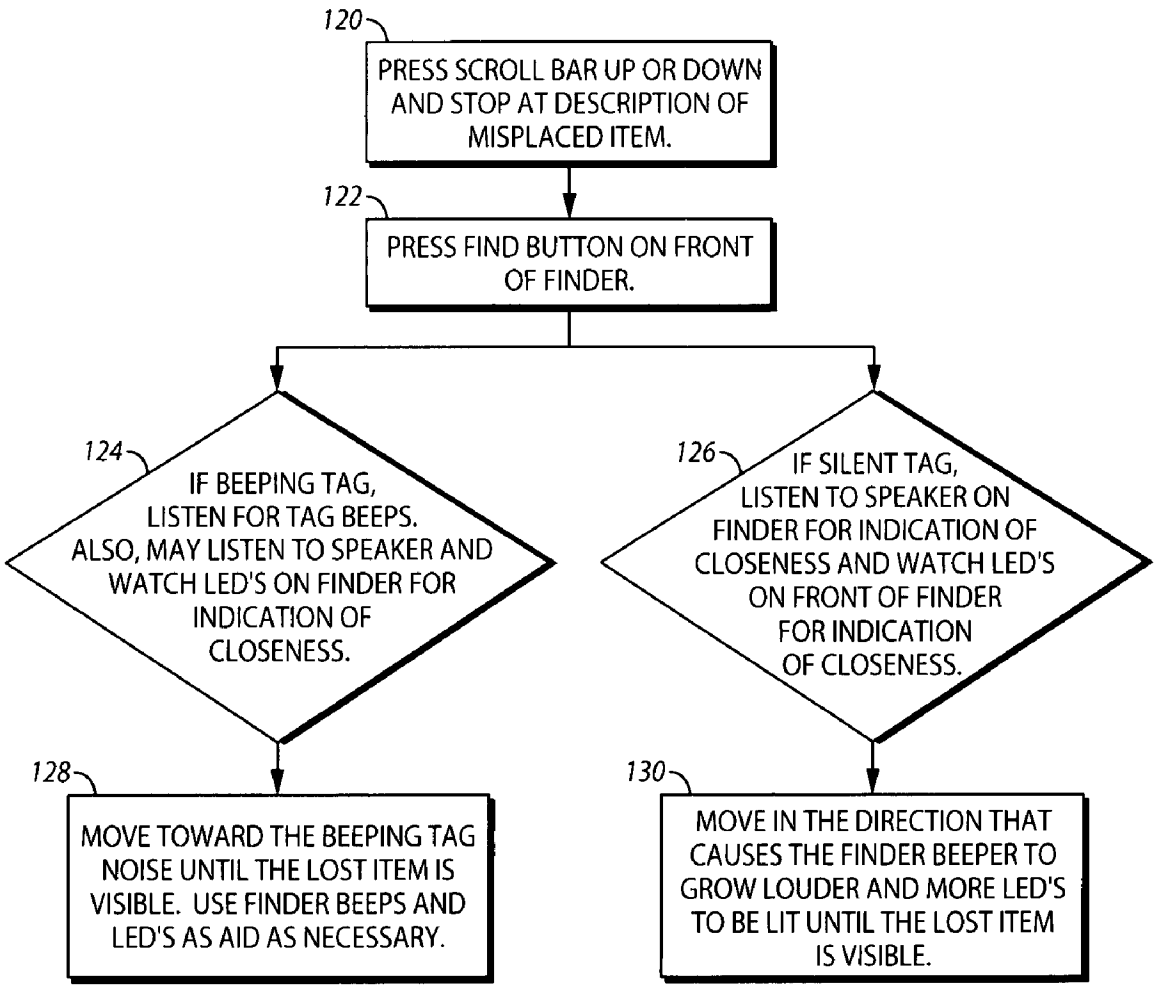
FIG. 14 is a flow diagram for finding a misplaced object using a system according to an embodiment of the present invention.

FIG. 14 shows a flow diagram for locating an object with the object locator system 10 after all tags have been suitably programmed and placed on objects to be tracked. When a user wishes to locate an object, they select the descriptive text associated with that object in the finder. This may be by pressing a scroll bar on the finder up or down to scroll through text entries that are visible on the LCD screen of the finder 12. The user stops at the text entry corresponding to the object that they wish to locate (step 120). Alternatively, depending on the embodiment of finder 12 used, the user may select a text entry by entering a few alphanumeric keys into the finder that the finder indexes to the correct item, by voice recognition, by transmission from a computer, or any other means. The user then presses the find button 32 on the front of the finder 12 (step 122). The finder 12 then accesses its memory to identify the tag identification code associated with the desired object, and begins to transmit a find signal including the tag identification code for the tag 4 that is attached to the object being searched for. The user would then typically walk around their premises holding the finder 12 so that they walk within 10–20 feet or so of any location that the object may be. The unobstructed range of the finder 12 is typically about 100 feet, but in a building the walls and interior features may reduce this range. Each tag 14 that receives the find signals checks the transmitted tag identification code with its own tag identification code, and does not respond if it is not the desired tag. Alternatively, each non-desired tag 14 can respond with a "no match" signal. The finder may remain on "find" mode until it receives a response from the desired tag, or may indicate to the user that it is not receiving any responses, or is receiving only "no match" signals.

If the tags 14 have a sound generator 70, the tag beeps to signal its presence. The user listens for a beeping signal (step 124). The user may also listen to the finder speaker and watch the LED indicator lights 40 for an indication of proximity of the tag 14 to the finder 12. The pitch or volume of beeps generated by the tag 14 and/or finder 12 may increase as the user holding the finder 12 gets closer to the tag 14. The LED indicator lights 40 may light up in sequence to indicate proximity of the finder 12 to the tag 14. If the tag 14 is silent (step 126), the user listens to the finder speaker and watches the LED indicator lights 40 without also listening for a beeping signal from the tag. The user moves towards the beeping tag noise (step 128) if a beeping tag is used, or moves in the direction that causes the finder beeps to grow loud or increase in pitch, or causes more LED's 40 to be lit (step 130). The lost object should by this time be visible to the user, or they can conduct a manual search for the object in the area indicated by the system 10.

In another embodiment of the invention, the object locator system 10 may make use of a network of radio frequency (RF) modules so that the user does not need to walk around a large building with the finder 12, which may be time-consuming. The network can make use of the electrical wiring in the building to form the network backbone, using a protocol in which a module can be plugged into any electrical outlet and the module is given a network identity. Such networks are known for controlling domestic electrical appliances such as lights. An RF module may be plugged into an electrical outlet in each room or area of a building. The RF modules may be similar to finders 12, or may have a different configuration to the finders 12. When the find button is pressed on the finder 12, or on a master finder 12, the finder polls all RF modules that are plugged into the wiring network. The RF modules then emit a search RF signal in each area of the building to locate a tag attached to a desired object. When the tag emits its found RF signal, the closest module or modules receive the signal and relay the signal to the finder. The finder can then display to the user the room or area of the building in which module that relayed the found signal is located. The user can then move to the location containing the module which responded to the finder, and can use the finder 12 to directly search for the tag using the proximity display or signal on the finder 12 to locate the tag within the narrowed search area, or can search for the object manually.

The object locator system 10 can be used in business settings, such as in offices and medical practices to locate files, in libraries to locate improperly filed books, in car dealerships and rental establishments, car fleet establishments such as police and government agency offices to locate keys for particular vehicles, in areas such as law enforcement facilities to track confiscated contraband and prisoners' personal possessions, by retailers, in laboratories, schools, universities and in many other establishments. The system can be used to locate tools or parts on a construction site. In a school setting, children may be given a tag to wear on their clothing when on a school trip for example, so that the teacher or adult supervisor may periodically check that all children are present in a designated area. The object locator system 10 can alternatively be used in domestic settings, to locate commonly lost objects such as keys, telephones, remote controls, eyeglasses, PDA's, pill bottles, toys, etc. In addition, in the domestic setting, the object locator system 10 can be used to locate infrequently used objects, or objects that are stored away, such as camping and sporting equipment, personal documents such as birth certificates, tax and financial records, CDs and/or DVDs containing stored information, photographs, music, movies, etc. Use of the object locator system prevents the user from having to search through their storage boxes or closets.

In a toy version, the system may be used with one finder 12 and a plurality of tags 14, or with a plurality of finders (one for each child or adult playing) and one or a plurality of tags. The tag itself may be the object of a game of hide-and-go-seek, or may be placed on objects to be found, such as Easter eggs, "treasure", party favors, and the like. Alternatively, the game may be to find tags in a specific order or to find only a specific tag or tags. With a game seeking specific tags, the finder may include an alphanumeric keypad so that the game can incorporate the spelling of a desired word or words in order to generate the correct "find" signal. Alternatively, the descriptive text may be the answer to a clue or question that must be worked out in order to generate the correct "find" signal. Incorrect answers may also generate a find signal that leads to a tag indicating that the answer was incorrect. The correct tag may be attached to a reward such as candy, money, an indication of game points earned, a small toy or the like. Alternatively, the finder may simply indicate that the child was correct when the child locates the correct tag. The question, or required spelling may be generated by the finder (in the case of spelling, the word may be audibly generated or recorded), or may be provided separately. Different questions and answers can be downloaded into the finder in order to vary the game. In one embodiment, the finder and/or tag(s) can include a timer so that the person finding a tag in the shortest amount of time can be determined to be the winner of the game.

The toy version can be used in sports or adult games such as orienteering, treasure hunts, etc, or in educational or instructional settings. In one embodiment, for example, a finder can be provided in a museum setting to each child visiting the museum. The finder can be triggered to set tasks for the child at various locations in the museum, or simply one after the other. The task may be to find an object or display such as identifying a Tyrannosaurus Rex from a dinosaur display. The tag may be embedded or otherwise hidden in or close to the correct object so that the finder indicates the correct object when the child stands near to it. The tag may include additional information that can be sent to the finder about the exhibit that the finder can display so that child can read about the object. Different finders can be programmed with different tasks so not all children are looking for the same exhibit at once.

It should be understood that the examples and embodiments described herein are for illustrative purposes only and that various modifications or changes in light thereof will be obvious to persons skilled in the art, and that such modifications or changes are to be included within the spirit and purview of this application. Moreover, the invention can take other specific forms without departing from the spirit or essential attributes thereof.

The invention claim is:

1. An electronic object location system comprising:

at least eight identification tags, each tag having RF send and receive capabilities, and each tag having an internal tag memory for storing a unique tag identification code associated therewith, each tag being attachable to an object; and a single portable finder having a processor and an internal finder memory, and RF send and receive capabilities, said finder storing a plurality of said unique tag identification codes in said finder memory, wherein said tag identification codes are associated in said finder memory with descriptive text identifying an object to a user, and wherein said descriptive text identifiers provide an intuitive object identifier;

wherein said finder is configured for direct communication with each individual identification tag of said at least eight of identification tags;

wherein said finder memory is programmable such that at least one of tag identification codes and descriptive text identifiers can be added, deleted and edited by the user, whereby a flexible number of identification tags can be used with the finder, wherein a user can select a stored descriptive text identifier for location of a desired object from said finder memory, and said finder then transmns a search RF signal to locate the identification tag associated with said desired object using the stored tag identification code associated with said selected descriptive text, the search RF signal including the selected tag identification code, wherein an identification tag in the vicinity of the finder receives the search RF signal and compares the transmitted rag identification code with its own tag identification code stored in said internal tag memory, wherein the identification tag responds to the finder by transmitting a found RF signal only if the transmitted tag identification code matches its own tag identification code, and wherein the finder signals to the user that the object with the selected descriptive text identifier has been located, said user signal indicating a relative proximity of the finder to the desired object.

2. The electronic object location system according to claim 1, wherein the finder is programmable so tat user-defined text may be associated wit each identification tag.

3. The electronic object location system according to claim 1, wherein the tag identification code is programmed RF the finder from stored tag identification codes prior to use of the tag.

4. The electronic object location system according to claim 1, wherein the selection of a descriptive text identifier is from a pre-defined list of descriptive text entries.

5. The electronic object location system according to claim 1, wherein the finder senses proximity to the identification tag by the strength of the found RF signal.

6. The electronic object location system according to claim 5, wherein the finder further comprises at least one visual indicator to visually signal proximity to the identification tag.

7. The electronic object location system according to claim 1, wherein the finder further comprises a sound generator to audibly signal proximity to the identification tag.

8. The electronic object location system according to claim 1, wherein the finder has a display for displaying the descriptive text identifiers for selection of tag to be searched for.

9. The electronic object location system according to claim 8, wherein the finder includes a scroller for scrolling up and down a list of descriptive text identifiers.

10. The electronic object location system according to claim 1, wherein the finder includes a keypad input.

11. The electronic object location system according to claim 1, wherein the tinder includes a text input device.

12. The electronic object location system according to claim 1, wherein the identification tag comprises a sound generator to generate a sound when identified to help in location thereof.

13. The electronic object location system according to claim 1, wherein the radio frequency of the search and found RF signals is in the range of 10 MHz–10 GHz.

14. The electronic object location system according to claim 13, wherein the radio frequency of the search and found RF signals is in the range of 27–50 MHz.

15. The electronic object location system according to claim 1, wherein the finder has a data input means for downloading data from a computer.

16. The electronic object location system according to claim 1, wherein the finder has rechargeable batteries.

17. The electronic object location system according to claim 16, wherein the finder has a charging cradle for recharging the batteries.

18. The electronic object location system according to claim 1, wherein the identification tag includes a battery, and wherein the identification tag can emit a signal when its battery is low of charge.

19. The electronic object location system according to claim 18, wherein the identification tag transmits an RF signal to the finder when its battery is low, and the finder displays a visual indication or emits a sound indication of a low tag battery.

20. The electronic object location system according to claim 18, wherein the identification tag emits a sound when its battery is low.

21. An electronic object location system comprising:

a plurality of identification tags, each tag having RF send and receive capabilities, and each tag having an internal tag memory for storing a unique tag identification code associated therewith, each rag being attachable to an object; and a portable finder having a processor and an internal finder memory, and RF send and receive capabilities, said finder storing a plurality of said unique tag identification codes in said finder memory, wherein said tag identification codes are associated in said finder memory with descriptive text identifying an object to a user, and wherein said descriptive text identifiers provide an intuitive object identifie;

wherein a user can select a stored descriptive text identifier for location of a desired object from said finder memory, and said finder then transmits a search RF signal to locate the identification tag associated with said desired object using the stored tag identification code associated with said selected descriptive text, the search RF signal including the selected tag identification code, wherein an identification zag in the vicinity of the finder receives the search RF signal and compares the transmitted tag identification code with its own tag identification code stored in said internal tag memory, wherein the identification tag responds to the finder by transmitting a found RF signal only if the transmitted tag identification code watches its own rag identification code, wherein the finder signals to the user that the object with the selected descriptive text identifier has been located, said user signal indicating a relative proximity of the finder to the desired object, wherein the tag identification code is programmed by the finder from stored tag identification codes prior to use of the tag, and wherein the finder includes at least one contact for mating with at least one contact provided on the identification tag for programming the identification code into the tag.

22. An electronic object location system comprising:

a plurality of identification tags, each tag having RF send and receive capabilities, and each tag having an internal tag memory for staring a unique tag identification code associated therewith, each tag being attachable to an object; and a portable finder having a processor and an internal finder niwnory, and RF send and receive capabilities, said finder storing a plurality of said unique rag identification codes in said finder memory, wherein said tag identification codes are associated in said finder memory with descriptive text identifying an object to a user, and wherein said descriptive text identifiers provide an intuitive object identifier;

wherein a user can select a stored descriptive text identifier for location of a desired object from said finder memory, and said finder then transmits a search RF signal to locate the identification tag associated with said desired object using the stored tag identification code associated with said selected descriptive text, the search RF signal including the selected tag identification code, wherein an identification tag in the vicinity of the finder receives the search RF signal and compares the transmitted tag identification code with its own tag identification code stored in said internal tag memory, wherein the identification tag responds to the finder by transmitting a found RF signal only if the transmitted tag identification code marches its own tag identification code, wherein the finder signals to the user that the object wit the selected descriptive text identifier has been located, said user signal indicating a relative proximity of the finder to the desired object, wherein the finder has rechargeable batteries and a charging cradle for recharging the batteries and wherein the finder emits a sound; f it is left off the charging cradle for longer than a predetermined time period.

23. An electronic object location system comprising:

a plurality of identification tags, each tag having RF send and receive capabilities, and each rag having an internal tag memory for storing a unique tag identification code associated therewith, each tag being attachable to an object; and a portable finder having a processor and an internal finder memory, and RF send and receive capabilities, said finder storing a plurality of said unique tag identification codes in said finder memory, wherein said tag idenafication codes are associated in said finder memory with descriptive text identifying an object to a user, and wherein said descriptive text identifiers provide an intuitive object identifier;

wherein a user can select a stored descriptive text identifier for location of a desired object from said finder memory, and said finder then transmits a search RF signal to locate the identification tag associated with said desired object using the stored tag identification code associated with said selected descriptive text, the search RF signal including the selected tag identification code, wherein an identification tag in the vicinity of the finder receives the search RF signal and compares the transmitted rag identification code with its own tag identification code stored in said internal tag memory, wherein the identification tag responds to the finder by transmitting a found RF signal only if the transmitted tag identification code matches its own tag identification code, and wherein the finder signals to the user that the object wit the selected descriptive text identifier has been located, said user signal indicating a relative proximity of the finder to the desired object, wherein the identification tag comprises circuitry attached to an object by a manufacturer.

24. The electronic object location system according to claim 23, wherein the finder interrogates the identification rag for its identification code at the time that the descriptive text identifier is associated with the tag.

25. A porrable finder for use in an electronic object locator system, the finder comprising:

a processor;

an internal finder memory;

RF send and receive capabilities; and at least one contact for mating with an identification tag for programming an identification code into the tag, wherein said finder stores a plurality of unique tag identification codes in said finder memory, wherein said tag identification codes are associated in said finder memory with descriptive text identifying an object to a user, and wherein said descriptive text identifiers provide an intuitive object identifier;

wherein a user can select a stored descriptive text identifier for location of a desired object from said finder memory, and said finder then transmits a search RF signal to locate an identification tag associated wit said desired object using the stored tag identification code associated with said selected descriptive text, the search RF signal including the selected tag identification code, wherein after a response from the selected identification tag, the finder signals to the user that the object with the selected descriptive text identifier has been located, said user signal indicating a relative proximity of the finder to the desired object.

26. The finder according to claim 25, wherein the selection of a descriptive text identifier is from pre-defined list of descriptive text entries.

27. The finder according to claim 25, wherein the finder senses proximity to the identification rag by the strength of the found response from the tag signal.

28. The finder according to claim 27, further comprising at least one visual indicator to visually signal proximity to the identification tag.

29. The finder according to claim 27, further comprising a sound generator to audibly signal proximity to the identification tag.

30. The finder according to claim 25, further comprising a display for displaying the descriptive text identifiers for selection of a tag to be searched for.

31. The finder according to claim 30, further comprising a scroller for scrolling up and down a list of descriptive text identifiers.

32. The finder according to claim 25, further comprising a keypad input.

33. The finder according to claim 25, further comprising a text input device.

34. The finder according to claim 25, wherein the radio frequency of the search and found RF signals is in the range of 10 MHz–10 GHz.

35. The finder according to claim 34, wherein the radio frequency of the search and response RF signals is in the range of 27–50 MHz.

36. The finder according to claim 25, further comprising a data input means for downloading data front a computer.

37. The finder according to claim 25, wherein the finder has rechargeable batteries.

38. The finder according to claim 37, further comprising a charging cradle for recharging the finder batteries.

39. A portable finder for use in an electronic object locator system, the finder comprising:

a processor, an internal finder memory; and

RF send and receive capabilities, wherein said finder stores a plurality of unique tag identification codes in said finder memory, wherein said tag identification codes are associated in said finder memory with descriptive text identifying an object to a user, and wherein said descriptive text identifiers provide an intuitive object identifier;

wherein a user can select a stored descriptive text identifier for location of a desired object from said finder memory, and said finder then transmits a search RF signal to locate an identification tag associated with said desired object using the stored tag identification code associated wit said selected descriptive text, the search RF signal including the selected tag identification code, wherein after a response from the selected identification tag, the finder signals to the user that the object with the selected descriptive tat identifier has been located, said user signal indicating a relative proximity of the finder to the desired object, wherein the finder has rechargeable batteries and a charging cradle for recharging the finder batteries, and wherein the finder emits a sound if it is left off the charging cradle for longer than a predetermined time period.

* * * * *

US007064663C1

(12) EX PARTE REEXAMINATION CERTIFICATE (8032nd)

United States Patent
Pucci et al.

(10) Number: US 7,064,663 C1
(45) Certificate Issued: Feb. 15, 2011

(54) RADIO FREQUENCY OBJECT LOCATOR SYSTEM

(75) Inventors: Donald Pucci, Boca Raton, FL (US); Bianca Gallo Pucci, Boca Raton, FL (US); Isay Goltman, Davie, FL (US)

(73) Assignee: Basix Holdings, LLC, Boca Raton, FL (US)

Reexamination Request:
No. 90/010,401, Mar. 17, 2009

Reexamination Certificate for:

| | |
|---|---|
| Patent No.: | **7,064,663** |
| Issued: | **Jun. 20, 2006** |
| Appl. No.: | **10/426,575** |
| Filed: | **Apr. 30, 2003** |

(51) Int. Cl.
*G08B 1/08* (2006.01)

(52) U.S. Cl. ..... 340/539.32; 340/572.1; 340/825.49

(58) Field of Classification Search ..... None
See application file for complete search history.

(56) References Cited

U.S. PATENT DOCUMENTS

| | | | | | |
|---|---|---|---|---|---|
| 4,656,463 | A | * | 4/1987 | Anders et al. | 340/573.4 |
| 5,939,981 | A | * | 8/1999 | Renney | 340/539.32 |
| 6,211,870 | B1 | * | 4/2001 | Foster | 715/744 |
| 6,297,737 | B1 | * | 10/2001 | Irvin | 340/571 |
| 6,788,199 | B2 | * | 9/2004 | Crabtree et al. | 340/539.13 |

* cited by examiner

*Primary Examiner*—Alexander J Kosowski

(57) ABSTRACT

An object location system having tags for tracking objects. A finder and tags each have a memory, and RF send and receive capabilities. The finder stores tag identification codes in its memory, and associates the tag identification codes with descriptive text identifying an object to a user. A user selects a descriptive text identifier to locate an object, and the finder transmits a search RF signal including the tag identification code to locate the tag attached to the desired object. The tags receive the search RF signal and compare the transmitted tag identification code with their own stored identification codes. A tag responds to the finder by transmitting a found RF signal if the transmitted and stored tag identification codes match. The finder signals to the user that the object with the selected descriptive text identifier has been located, and indicates a relative proximity of the finder to the object.

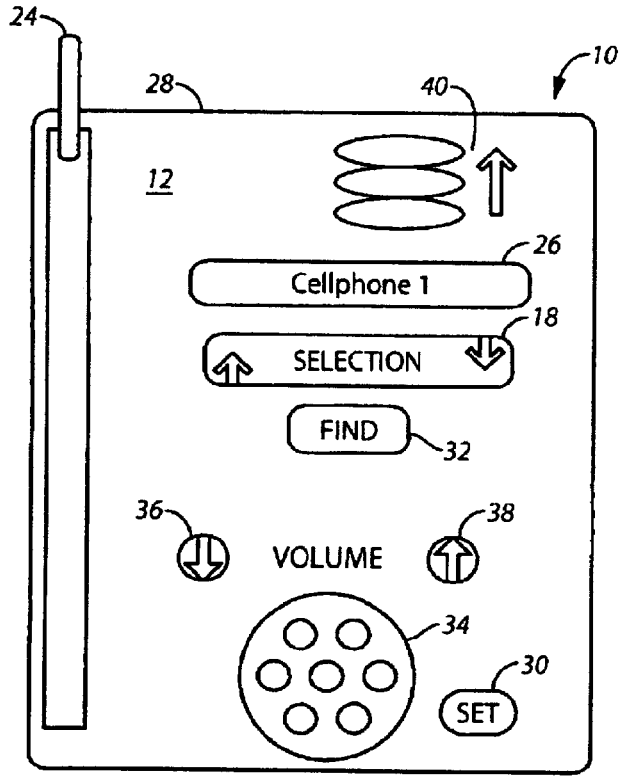

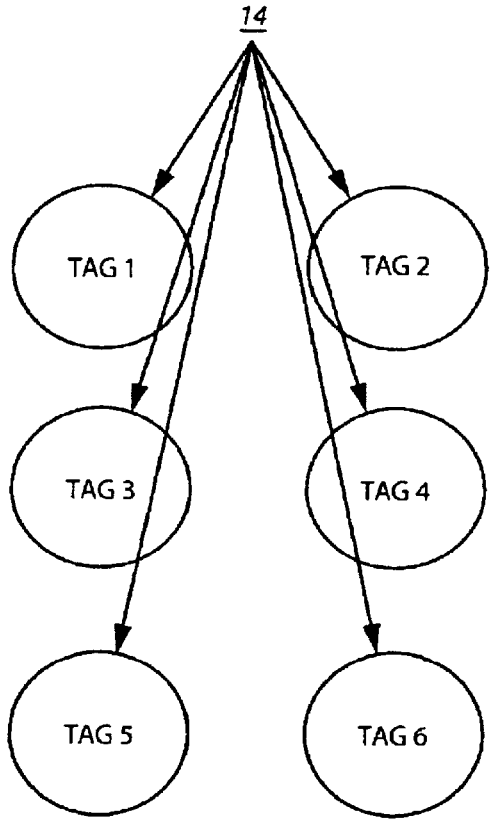

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-3, 5-20 and 23 are cancelled.

Claim 4 is determined to be patentable as amended.

New claims 40-53 are added and determined to be patentable.

Claims 21-22 and 24-39 were not reexamined.

4. [The] *An* electronic object location system [according to claim 1] *comprising:*

*at least eight identification tags, each tag having RF send and receive capabilities, and each tag having an internal tag memory for storing a unique tag identification code associated therewith, each tag being attachable to an object; and*

*a single portable finder having a processor and an internal finder memory, and RF send and receive capabilities, said finder storing a plurality of said unique tag identification codes in said finder memory, wherein said tag identification codes are associated in said finder memory with descriptive text identifying an object to a user, and wherein said descriptive text identifiers provide an intuitive object identifier;*

*wherein said finder is configured for direct communication with each individual identification tag of said at least eight of identification tags;*

*wherein said finder memory is programmable such that at least one of the tag identification codes and descriptive text identifiers can be added, deleted and edited by the user, whereby a flexible number of identification tags can be used with the finder,*

*wherein a user can select a stored descriptive text identifier for location of a desired object from said finder memory, and said finder then transmits a search RF signal to locate the identification tag associated with said desired object using the stored tag identification code associated with said selected descirptive text, the search RF signal including the selected tag identification code,*

*wherein an identification tag in the vicinity of the finder recieves the search RF signal and compares the transmitted tag identification code with its own tag identification code stored in said internal tag memory,*

*wherein the identification tag responds to the finder by transmitting a found RF signal only if the transmitted tag identification code matches its own tag identification code,*

*wherein the finder signals to the user that the object with the selected descriptive text identifier has been located, said user signal indicating a relative proximity of the finder to the desired object, and* wherein the selection of a descriptive text identifier is from a pre-defined list of descriptive text entries.

*40. The electronic object location system according to claim 1,*

*wherein at least one component selected from the group consisting of the finder and one of the identification tags comprises a sound generator that emits a beep when a tag identification code is added to the finder memory.*

*41. The electronic object location system according to claim 4, wherein the finder comprises a display for displaying the descriptive text identifiers for selection of tag to be searched for and a text input device, and is programmable so that user-defined text may be associated with each identification tag.*

*42. The electronic object location system according to claim 4, wherein the tag identification code is programmed by the finder using a radio frequency signal without the need for contacts from stored tag identification codes prior to use of the tag.*

*43. The electronic object location system according to claim 4, wherein the finder further comprises a sound generator to audibly signal proximity to the identification tag.*

*44. The electronic object location system according to claim 4, wherein the identification tag comprises a sound generator to generate an audible sound when identified to help in location thereof.*

*45. The electronic object location system according to claim 4, wherein the identification tag transmits an RF signal to the finder when its battery is low, and the finder displays a visual indication or emits a sound indication of a low tag battery.*

*46. The electronic object location system according to claim 4, wherein the finder comprises a plastic case comprising a set button for programming the identification tags and a find button to begin the identification tag locating operation.*

*47. The electronic object location system according to claim 40, wherein the finder comprises a display for displaying the descriptive text identifiers for selection of tag to be searched for and a text input device, and is programmable so that user-defined text may be associated with each identification tag.*

*48. The electronic object location system according to claim 40, wherein the tag identification code is programmed by the finder using a radio frequency signal without the need for contacts from stored tag identification codes prior to use of the tag.*

*49. The electronic object location system acording to claim 40, wherein the finder further comprises a sound generator to audibly signal proximity to the identification tag.*

*50. The electronic object location system according to claim 40, wherein the identification tag comprises a sound generator to generate an audible sound when identified to help in location thereof.*

*51. The electronic object location system according to claim 40, wherein the identification tag transmits an RF signal to the finder when its battery is low, and the finder displays a visual indication or emits a sound indication of a low tag battery.*

*52. The electronic object location system according to claim 40, wherein the finder comprises a plastic case comprising a set button for programming the identification tags and a find button to begin the identification tag locating operation.*

*53. The electronic object location system according to claim 40, wherein the selection of a descriptive text identifier is from a pre-defined list of descriptive text entries.*

* * * * *